US006070858A

United States Patent [19]

Hase et al.

[11] Patent Number: 6,070,858

[45] Date of Patent: Jun. 6, 2000

[54] SINGLE LOOP TRACTIONED WINCH-LIKE DEVICE

[75] Inventors: Peter Hase, Wedel; Ewald Ettrich, Hamburg, both of German Dem. Rep.

[73] Assignee: Anke Hase, Germany

[21] Appl. No.: 09/076,354

[22] Filed: May 12, 1998

Related U.S. Application Data

[63] Continuation of application No. 09/007,154, Jan. 14, 1998, and a continuation of application No. 08/727,413, Oct. 17, 1996, abandoned.

[51] Int. Cl.[7] ..... B66D 1/30

[52] U.S. Cl. ..... 254/371; 254/342

[58] Field of Search ..... 254/342, 371, 254/372, 374, 382

[56] References Cited

U.S. PATENT DOCUMENTS

| | | | |
|---|---|---|---|
| 3,078,074 | 2/1963 | Benedict . | |
| 3,120,043 | 2/1964 | Henley | 254/371 |
| 3,120,343 | 2/1964 | Henley | 254/371 X |
| 3,302,932 | 2/1967 | Wallin | 254/371 X |
| 3,635,441 | 1/1972 | Haines | 254/371 |
| 3,934,482 | 1/1976 | Byers | 254/371 X |
| 3,968,953 | 7/1976 | Guangorena | 254/342 |
| 4,151,980 | 5/1979 | Burton et al. | 254/371 |
| 4,440,354 | 4/1984 | Kobayashi et al. | 254/342 X |
| 4,463,932 | 8/1984 | Shuker | 254/342 X |
| 4,523,744 | 6/1985 | Bonassi | 254/371 |
| 4,580,766 | 4/1986 | Woodgate | 254/371 |
| 4,603,839 | 8/1986 | Ekman et al. | 254/371 X |
| 5,238,227 | 8/1993 | White | 254/371 X |
| 5,314,166 | 5/1994 | Muir | 254/371 |
| 5,332,195 | 7/1994 | Sugiyama | 254/371 |
| 5,346,181 | 9/1994 | Cook, Jr. et al. | 254/374 |

FOREIGN PATENT DOCUMENTS

| | | | |
|---|---|---|---|
| 96429 | 12/1983 | European Pat. Off. | 254/371 |
| 0 364 429 | 4/1989 | European Pat. Off. . | |
| 2 255 253 | 3/1974 | France . | |
| 2 371 878 | 11/1977 | France . | |
| 26 02 629 | 1/1976 | Germany . | |
| 67967 | 7/1973 | Luxembourg . | |
| 327560 | 4/1930 | United Kingdom . | |
| 2 034 661 | 6/1980 | United Kingdom . | |
| 2 255 763 | 11/1992 | United Kingdom . | |
| 2275243 | 8/1994 | United Kingdom | 254/371 |

*Primary Examiner*—Donald P. Walsh
*Assistant Examiner*—Emmanuel M. Marcelo
*Attorney, Agent, or Firm*—Kelly Bauersfeld Lowry & Kelley, LLP

[57] ABSTRACT

A device is provided for tensioning lines (ropes, cables or wires). In order to improve a device for gripping and tensioning ropes, cables or wires, particularly in sheet or hoisting winches or windlasses, in tackles or pulley blocks or pulley lifting tackle, permanently or operationally interconnected coniform discs are provided which can be actuated by motor or by hand via a crank or a tackle line, and which exhibit surface contours, such that with only a single loop of the tensioning line a secure clamping effect of the coniform discs on cable put through in only a single loop is attained without the occurrence of wear or snapping of the tensioning line. Putting through and releasing (slackening) of the line is facilitated, and the improvement takes effect with respect to both rotation directions independent of the direction. The surface contouring of the discs is implemented as inwardly directed radial waves of the described form which are designed as straight lines or curves.

27 Claims, 7 Drawing Sheets

FIG. 3a
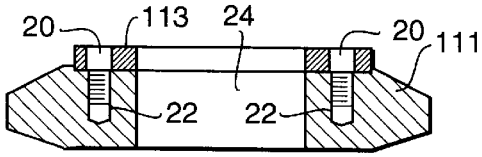
FIG. 3
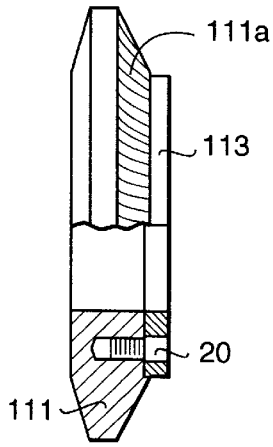
FIG. 3b
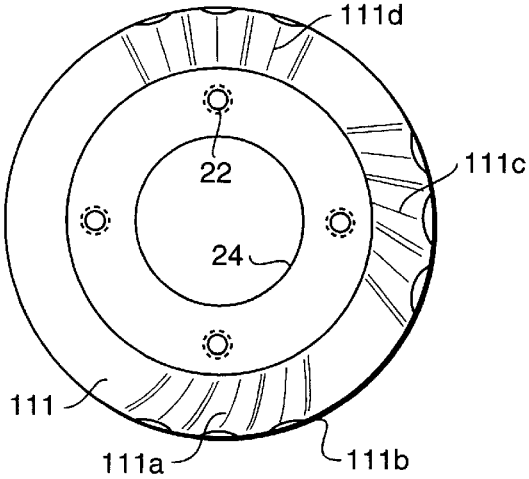
FIG. 4a
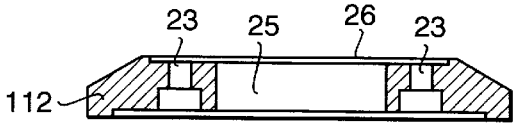
FIG. 4b
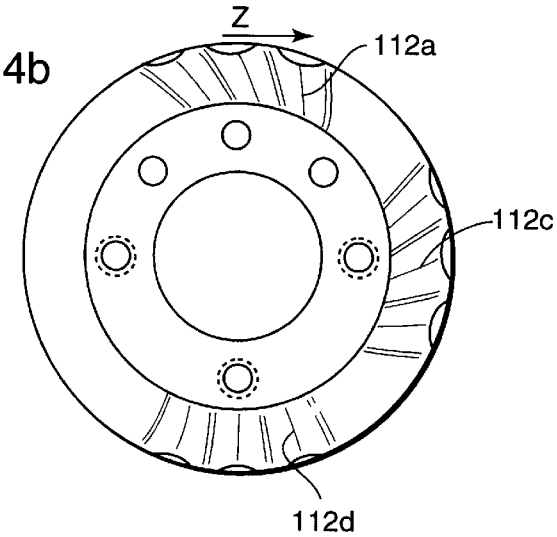
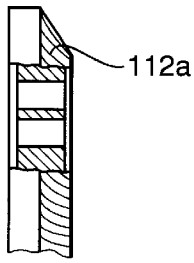
FIG. 4c

SINGLE LOOP TRACTIONED WINCH-LIKE DEVICE

RELATED APPLICATION

This is a continuation of U.S. Pat. application Ser. No. 09/007,154, filed Jan. 14, 1998, which was a continuation of U.S. Pat. application Ser. No. 08/727,413, filed Oct. 17, 1996, now abandoned.

BACKGROUND OF THE INVENTION

The invention relates to a device for gripping and tensioning ropes, cables and lines, particularly in sheet-winches, hoisting winches or windlasses, in tackles or pulley blocks by means of permanently or operationally interconnected coniform discs which can be actuated by motor or by hand via a crank or a tackle line and which exhibit surface contours producing sufficient retention force with only a single loop of the means of traction.

Similar devices are shown in DE 26 02 629 C3 and DE 25 52 436 C2. In these embodiments, the force transmitting organs, namely the ropes, cables or lines, are gripped by self-induced friction between coniform discs or by arrest of the transmitting means in order to ensure sufficient frictional force even with high loads if necessary, in a multiple winding around the drum as in DE 27 40 090 C2.

Other devices for retaining, drawing in or letting out cables of infinite or average length without winding the cable onto a drum are known. In these, means are provided to enable pulling the cable in both directions irrespective of its length. This purpose provides a running roller with a groove in which, through self-actuation, the cable is gripped by movable cheeks with the result that any length of the cable can be drawn in or let out. However, these cheeks make rapid looping of the tensioning means difficult, and moreover, the forces applied by one cheek are not always sufficient to arrest the cable adequately in the tensioning device. As a result of the relatively large tractive forces acting on the tensioning means the cheek is also subject to large pulling forces.

Furthermore, all profile designs known so far have the disadvantage that they are based on the principle of friction and do not grip reliably with a single loop, making additional loops to increase friction necessary. This undesirably increases the construction height of winches as in DE 27 40 090 C2, or effects considerable scuffing on the cable surface as in the profiles described in DE-GM 75 00 571.

SUMMARY OF THE INVENTION

An objective of the present invention is to improve upon prior gripping and tensioning devices to such an extent that the reliable clamping effect of the coniform discs is attained by a cable laid over in a single loop without resulting in an abrasive or destructive effect on the cable even with loads of 10 kN or more. Another objective is to provide such devices wherein the looping of the transmitting means is made possible with only one hand and self-locking without danger of overrun so that for the subsequent manual tensioning by means of a crank or tackle line both hands can be used still another objective is to provide a device wherein releasing (slackening) can take place quickly and with one hand, hauling and slackening under heavy loads is made possible via a force augmenting screw thread, and wherein weight and construction height can be reduced considerably (up to around 50%).

The design according to the invention is such that the profiles of the coniform discs are so fashioned that the retention force is primarily produced by clamping and not by frictional tightening as in the embodiments known so far. Here, the surface contours are designed such that a longitudinal deformation of the lines and thus a volume swelling takes place through conical inwardly narrowing waves when the lines make contact. By displacement of the upper to the lower wave profile, the overall volume swelling of the line is forced into the trough of the opposite wave. According to the invention the wave is so designed that the flank of the profile in the direction of pull is steeper than in the runoff direction in order to prevent pulling the cable through. Advantageously, the steepness of the pulling wave flank and the rounding of the wave crests is fashioned in such a way that no notch effect occurs which may damage the cable or its sheathing. In this way, a substantial improvement of the clamping action is achieved without the type of wear that is capable of destroying the cable. Webbing and ribbing are also to be understood as waves.

In order to augment the clamping action by an inwardly disposed component, the profile can be set in curved or straight lines against the pull direction.

An arm, a peg or a roller securing the loop is fitted with its longitudinal axis parallel to the rotational axis of the drum on the base construction on which the cable drum or coniform discs are rotatably arranged. This advantageously prevents an unintentional pull on the loose end of the line or sheet whereby the tensioning means would be pulled out of the clamping groove. Further, such a guide peg or roller serves to fix a minimal winding around the drum or the groove of the coniform discs.

According to the invention this roller is to be arranged on a spring held lever moveable in the radial direction.

It can also be meaningful to arrange this peg, spring mounted in the rotative pull direction, in the looping direction in order to achieve maximal possible looping on the one hand, and on the other hand to minimize the looping by resetting the peg against the spring pressure and thus make the release (slackening) of the tensioning means possible.

If a guide-deflector, also parallel to the rotational axis, is attached to the base construction then so-called over-runners, which occur if the free or loose end of the line is pulled under the hauling (tensioned) line and thus pinched in, can be effectively prevented. The peg or roller and the guide-deflector are preferably positioned at around the same distance from the longitudinal drum axis. They may also be combined in a single element.

According to a further embodiment of the invention, the guide-deflector possesses a finger or cuneiform arm projecting into the wedge-shaped groove between the coniform discs but at a distance from them.

The distance to the trough of the groove should correspond to a maximum of the thickness of the cable or rope to be tensioned. This prevents against multiple looping of the drum and dangerous over-runners.

The device is, moreover, equipped with a step-down gear, a preceding conical disk braking mechanism, and with a ratchet clutch which can be deactivated for direct drive of the cable drum.

BRIEF DESCRIPTION OF THE DRAWINGS

The accompanying drawings illustrate the invention. In such drawings:

FIGS. 3, 3*a* and 3*b* are three different views with alternative profile designs of an upper and lower coniform disc with staggered contouring;

FIGS. 4*a–c* are three different views of a lower coniform disc with alternative contour designs;

DETAILED DESCRIPTION OF THE PREFERRED EMBODIMENTS

Figure 1:
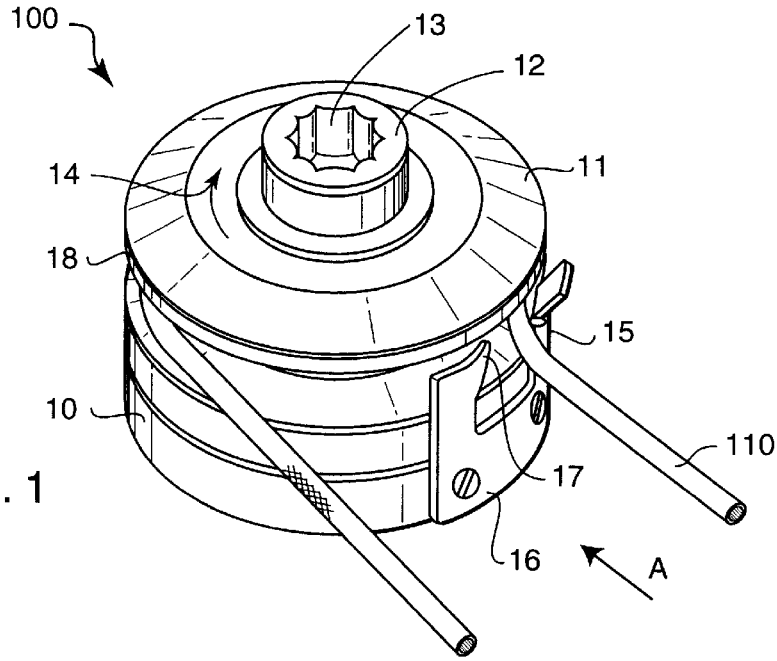
FIG. 1 is a perspective view of a device according to the invention with an inserted cable.
Figure 1A:
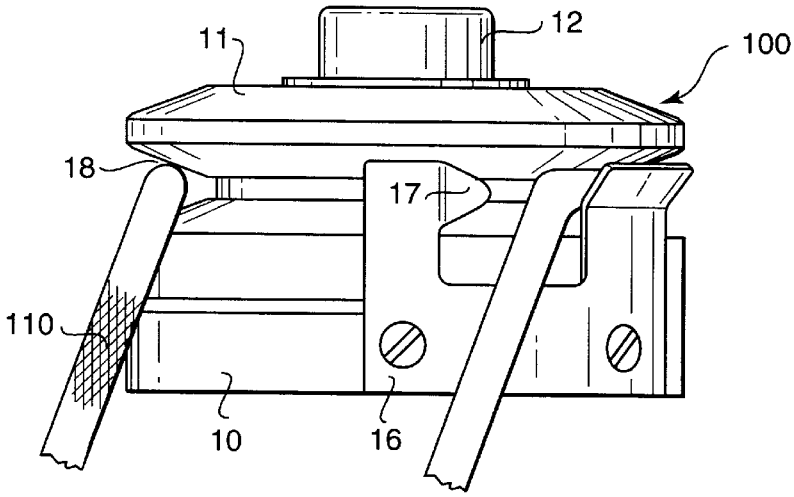
FIG. 1*a* is a view from the pull direction of the cable.

The winch 100 represented in FIG. 1 is basically known from DE 26 02 629 C3. On the base construction 10 a rotatable drum 11 is known which consists of two coniform discs 111, 112 rotatable on bearings, and into the groove of which a cable 110 can be laid. The drum 11 possesses a drive head 12 with a recess 13 into which a ratchet crank not shown in the drawing can be inserted.

If the ratchet crank is turned in the direction of the arrow 14, the drum is moved with it via carrier elements provided for the purpose, and during which the drum is blocked in the opposite rotational direction. Preferably, a ratchet mechanism can be used which, depending on crank rotation, frees the desired direction but blocks the opposite direction on letting go of the crank, and the other way around.

Mounted on the base construction 10 parallel to the rotational axis of the drum 11 and at a short distance from the wedge-shaped groove of the coniform discs are an arm, a roller or a peg 15 as well as a guide-deflector 16. The latter possesses a cuneiform protuberance 17 projecting into the wedge-shaped groove 18 between the coniform discs 111 and 112 but at a distance from the wedge-shaped groove trough 18*a*. The distance should be less than the thickness of the cable or rope 110 to be tensioned.

Figure 2:
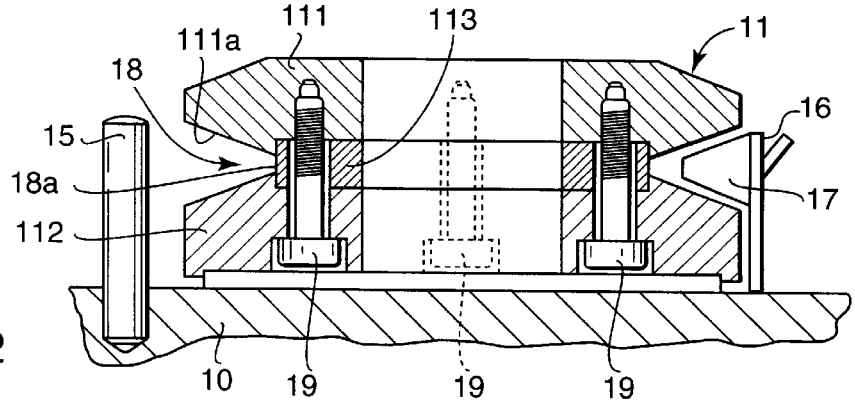
FIG. 2 is a cross-section of the device according to FIG. 1.

As can be seen in FIG. 2 the drum 11 comprises an upper coniform disc 111 and a lower coniform disc 112 centered by a sleeve 113 which enables adjustment to different cable diameters by changes in its height, and which are joined by bolts 19, and are arranged rotatable relative to the base construction 10. The rotatable bearings are known according to the state of the art so that no further details need be gone into on the subject. In FIG. 2 the looping pin 15 is shown offset in the plane of the drawing for illustration purposes.

The upper coniform disc 111 shown in FIGS. 3*a–b* possesses straight-line or curved contours consisting of radially arranged waves on its inner side 111*a*. The pitch of these corresponds to about a half to a full cable thickness, and their contours are staggered by ½ pitch relative to the lower coniform disc.

The contour crests are directed inwardly as in 111*a, c, d* in such a way that the pitches of the upper relative to those of the lower are staggered by a ½ pitch opposed to each other. The angle alpha of the coniform disc contours can be adapted to the cable type.

Four bolts 19 pass through the drill holes 20 in the sleeve 113 and are screwed into correspondingly tapped pocket drillings 22 for fastening purposes.

The lower coniform disc 112 shown in FIGS. 4*a–c* possesses drill holes 23 through which the bolts 19 pass, just as a central boring 24 to 25 as in the upper coniform disc to accommodate the drive head 12 or a sleeve shaft to warrant the rotational capacity of the of the drum 11 relative to the base construction 10.

The contours 112*a, c, d* of the lower coniform disc match 111*a, c, d* with regard to the profile run and orientation of the contours under the condition that they are negatively correlated for bilaterally effective winches. This means that the contours located on the lower of two discs 111 and 112 set on top of each other exhibit an anti-clockwise progression and the contours of those located on the upper disc clockwise. Guidance of the cable relative to the trough of the groove 18*a* in the rotational direction is assured on the one hand by the contouring 111*a, c* or 112*a, c*, whereas the reverse contouring on the opposite side increases the frictional effect of the tensioning means inserted. The pull direction is designated by Z here. The groove trough 18*a* is formed by a cylindrical sleeve which centers both coniform discs and by means of which the distance adjustment for different cable sizes ensues.

The contouring shown in FIGS. 5 and 6*a–c* is intended to show that the retention force of the coniform drums is effected by a positively engaging profile which is so designed that on the one hand it generates the required retention, and on the other hand that the ropes, cables or lines are not worn-out, or braided sheathing overstressed or torn.

Figure 6A:
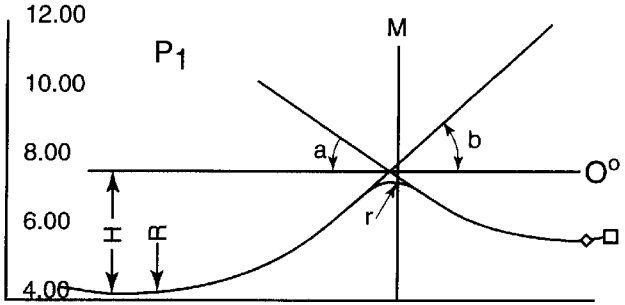
FIGS. 6*a–c* are a diagrammatic sectional representations of the contour shaping at points P1, P2 and P3 in FIG. 5.
Figure 6B:
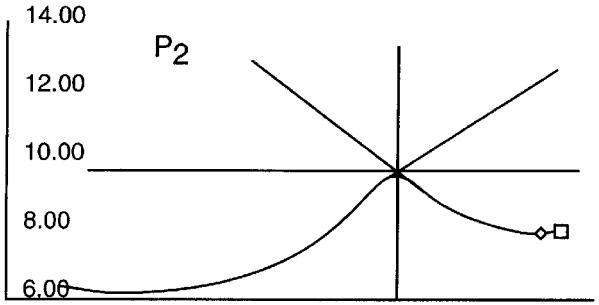
Figure 6C:
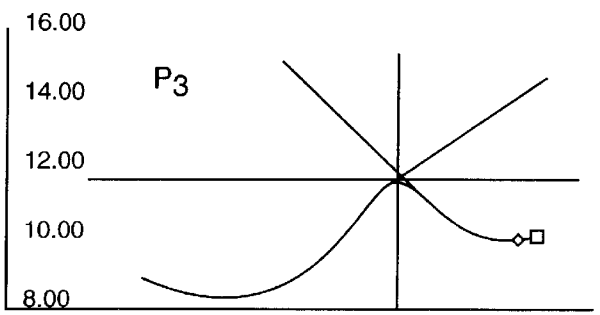
Figure 5:
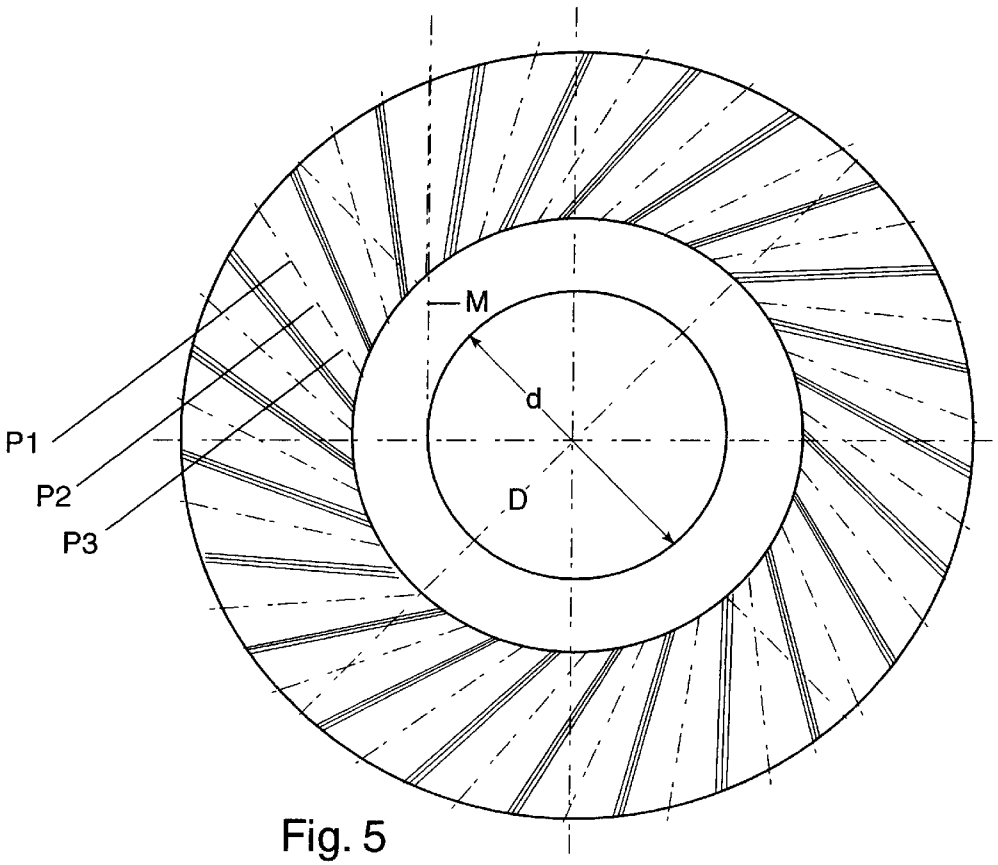
FIG. 5 is simple diagrammatic representation of a further contour design.
Figure 8:
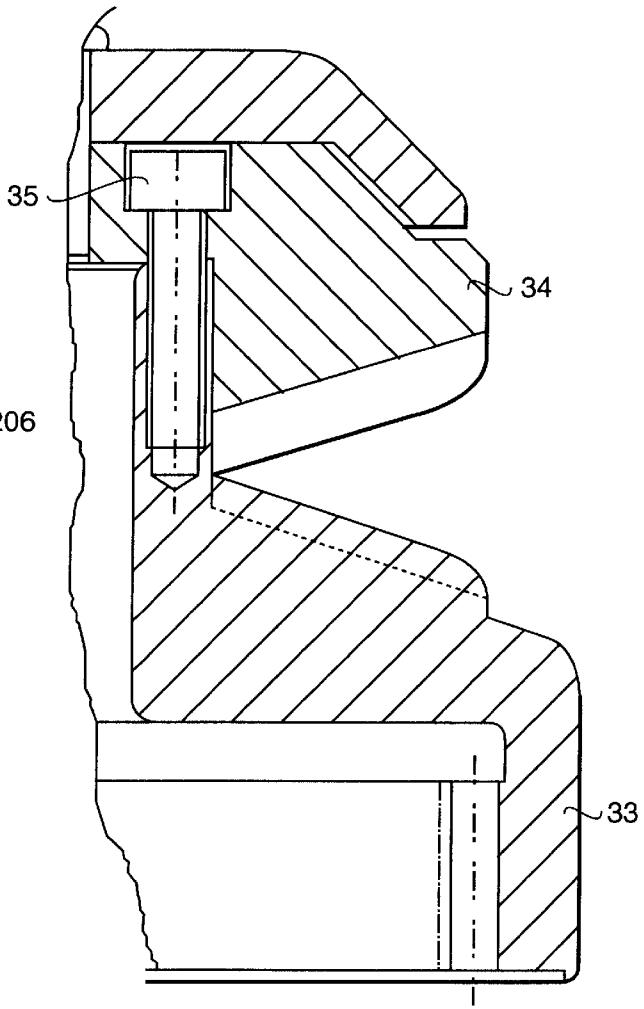
FIG. 8 is a detailed representation of FIG. 7.
Figure 7:
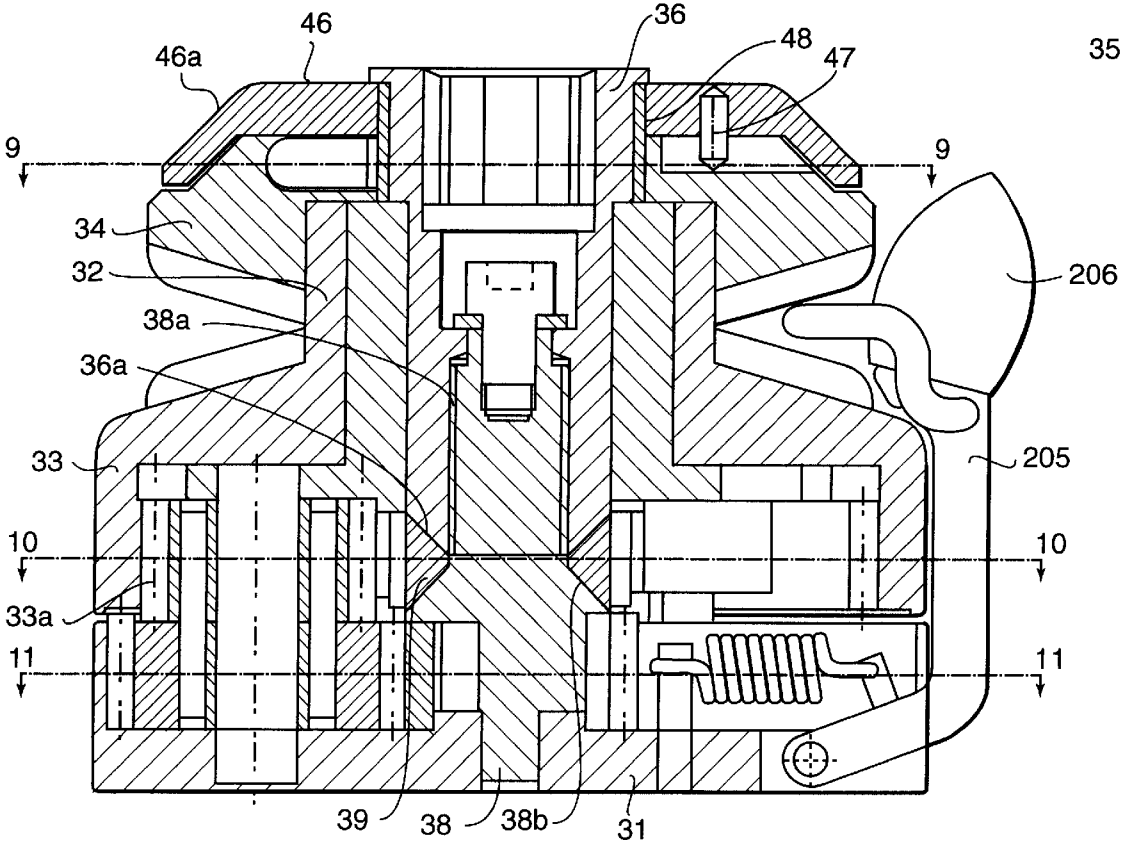
FIG. 7 is a sectional representation of a further embodiment form of the device.
Figure 9:
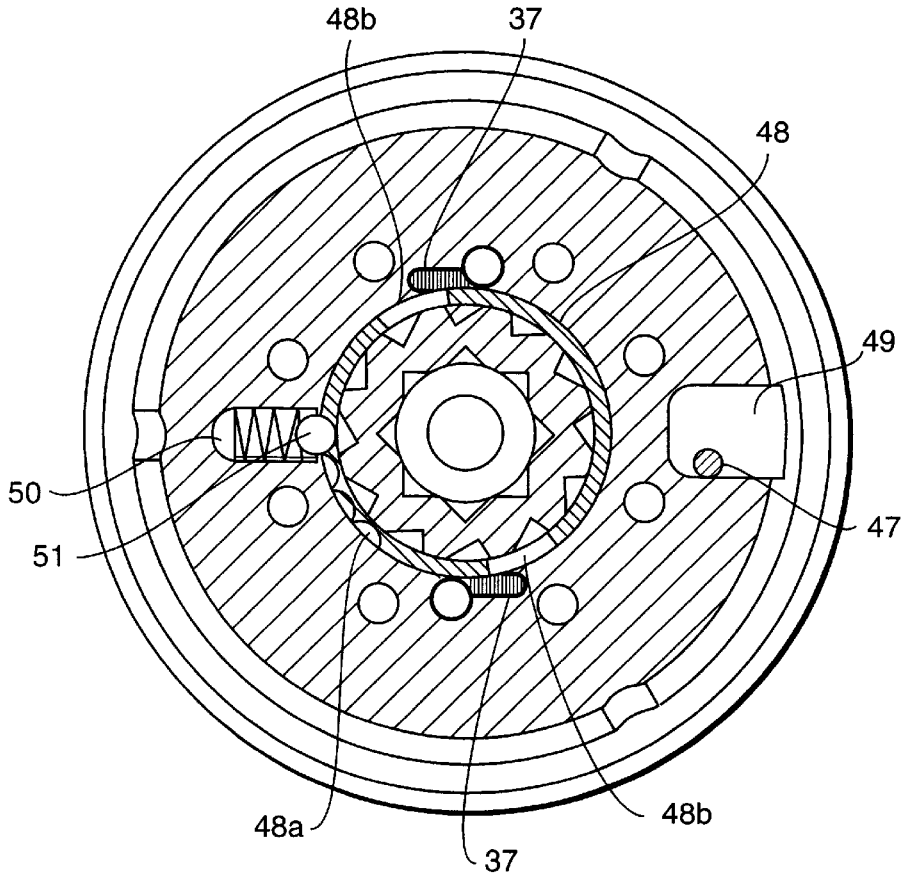
FIGS. 9–11 are sectional representations according to the intersection lines 9—9, 10—10 and 11—11 in FIG. 7.
Figure 9A:
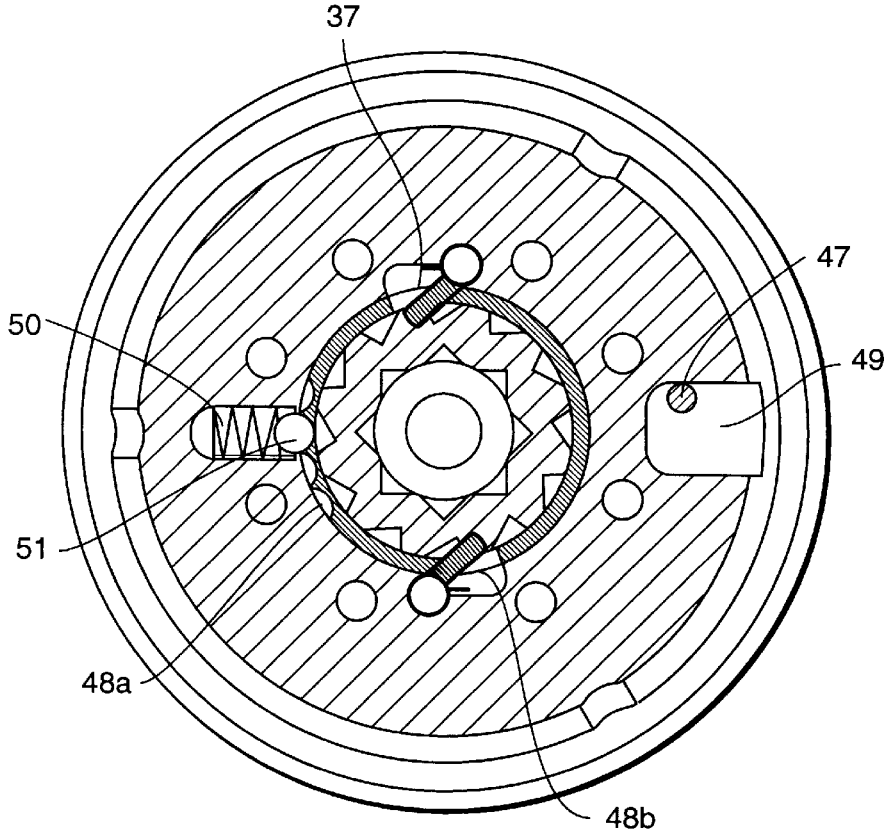
Figure 10:
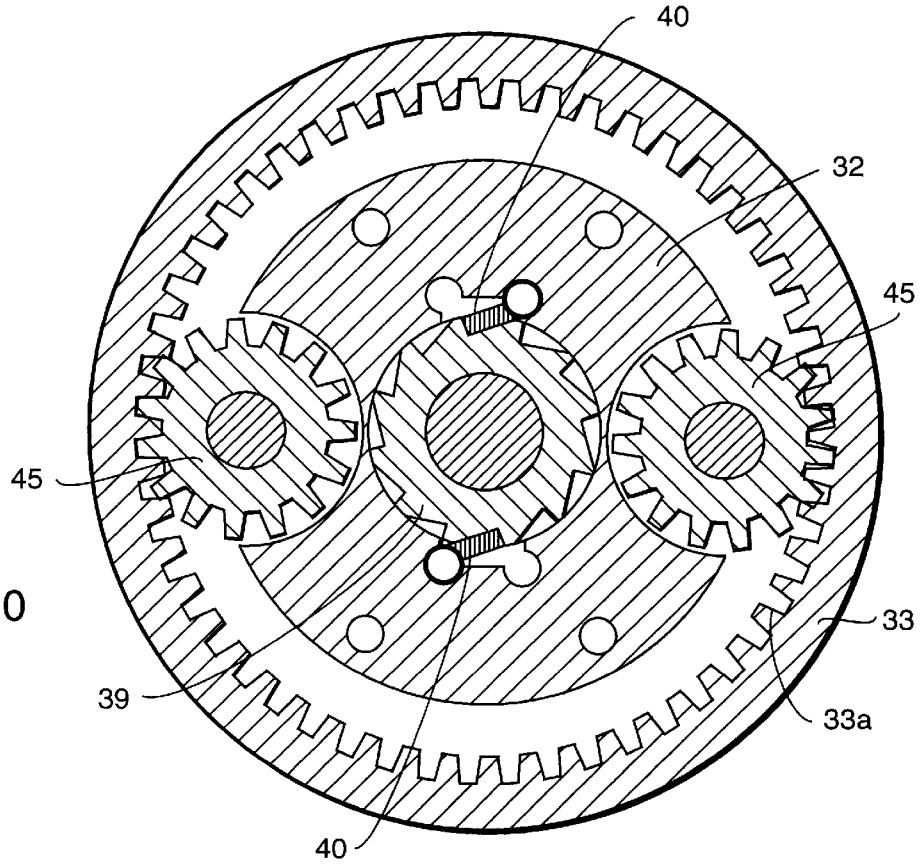
Figure 11:
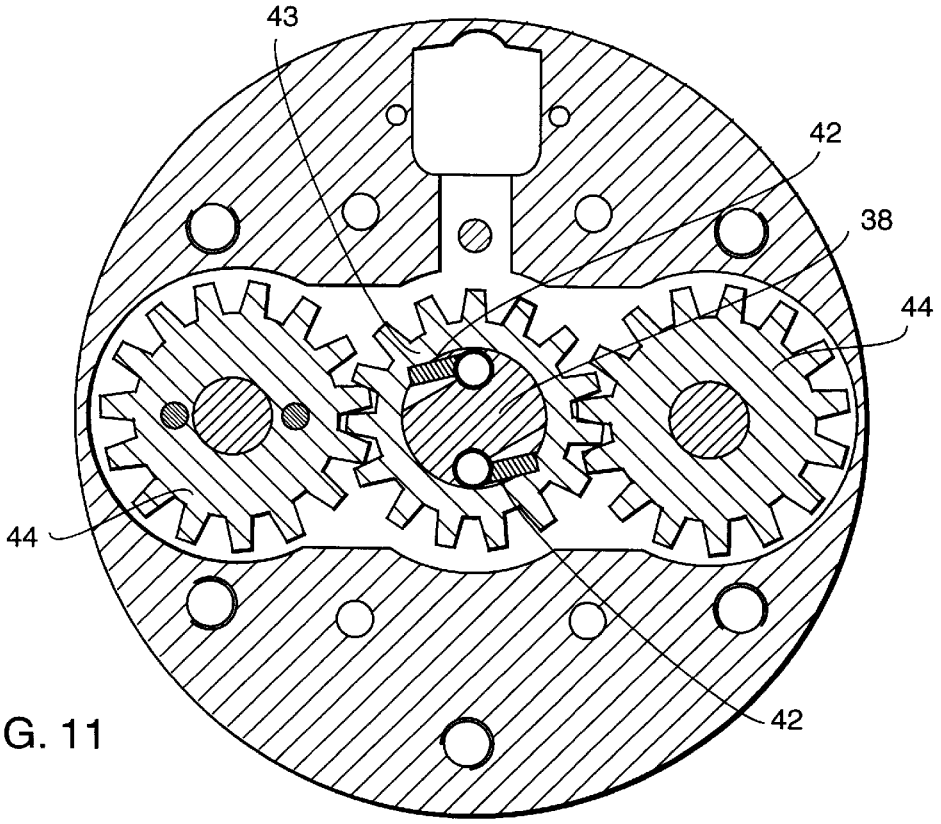
Figure 12:
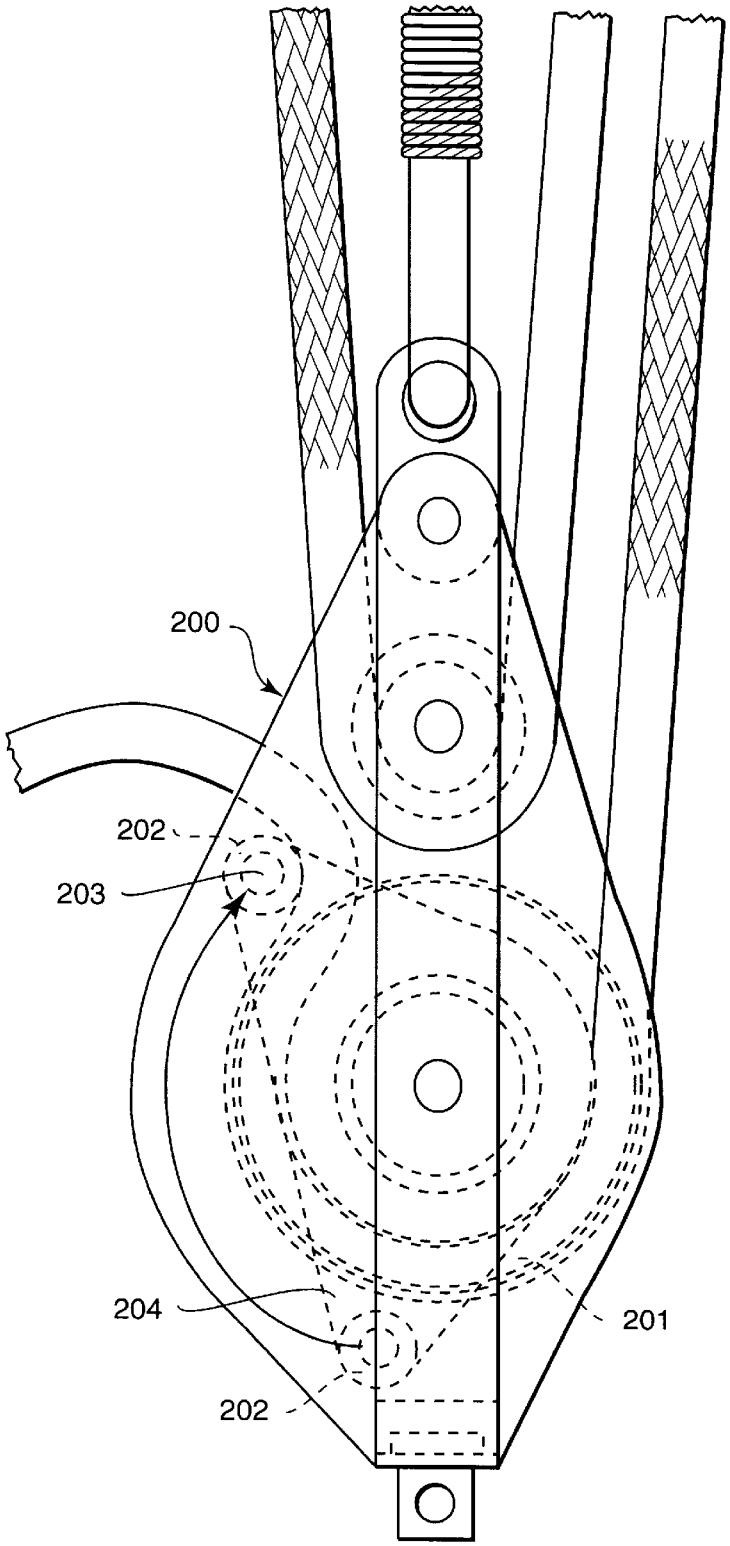
FIGS. 12 and 13 are two views of an application according to the invention which show a violin pulley of a large sheet block and tackle with a clamping roller 201 according to the invention and a spring mounted looping pin 202.

The design of the contours is such as can be particularly recognized from FIGS. 6*a* to 6*c*. The trough radius R of the drum contours in the circle of contact with the rope, cable or line corresponds to the radius of the rope, cable or line and is equivalent to or smaller than this. The crest radius r of the contour on the contact diameter is greater than 1.5 mm and less than 3 mm (1.5 mm<r<3 mm).

The angle of the contour set against the pull direction is 35°–45°, depending on the application, and the center line M of the of the contour runs through the center of the drum or is tangent to a circle of diameter d which is smaller than the outside diameter D of the drum.

In the most preferred form the contours of the upper coniform disc are to be arranged in the opposite i.e. mirror image direction of the contours of the lower coniform disc.

It is intended that the height H of the contours be at least 2 mm and maximally 3 mm, and that the flank angle alpha of the of the contour in the pull direction be steeper than on the opposite side (flank angle beta) of the contour. The upper surface of the contour is provided with a case hardened layer to reduce wear.

FIGS. 6*a–6c* represent a calibratable grid on the diagram paper of the contour measuring device, upon which the contour sections P1-P2-P3 were recorded. Since the features were described here by the reference marks H, R, $\alpha,\beta$, no calibration of the grid was effected so that the figures here do not posses any dimensional meaning.

In FIG. 7 to FIG. 12 the winch 200 is represented as a further embodiment. Outside the coniform discs 11, 112 is arranged a radially spring loaded lever 205 mounted on bearings in the base. Located on the lever 205 is a roller 206 with friction, ball or roller bearings which secures the loop and offers the least resistance to the line running through. A bearing flange 32 is bolted onto a base construction 31. Rotationally resting on bearings above it is the lower part 33 of the drum connected with the upper part 34 of the drum by means of bolts 35. With a locally rotating crank, the drive of the winch drum can be coupled directly with the drum via the crank socket 36 and the drum ratchets 37 (line 9—9). In this process the locking ring brake which comprises a clamping cone 36*a*, a brake cone 36*b* and gear shaft 38 opens such that the ratchets 40 (line 10—10) can grip, but the ratchet braking ring 39 can rotate freely. The gear ratchets 42 cannot grip and the gear shaft 36 turns freely in the central pinion 43. The planet set of gears driven by the drum gearing 33*a* and consisting of a central pinion 43, intermediate wheels 44 and planet wheels 45 overhauls the direct coupling and simply turns freely. If the pulling load in the cable increases to such an extent that the 1:1 drive is no longer sufficient and the crank movement is discontinued then the drum (3 and 4) is pulled back so far by the pulling cable until the gear ratchets 42 take effect in the central pinion 43. The central pinion is coupled to the gear shaft 36 which now screws into the crank socket 36 with its left-hand thread 38*a*, clamping the locking brake ring 39 and carrying it through with left-hand rotation until the ratchets 40 take hold in the locking ring 39. The winch is blocked by this and the pulling force restrained. If the actuation crank and thus the crank socket is rotated to the left then the ratchets 37 cannot take effect, the left-hand thread of the crank socket 36 clamps the braking disc 39 against the thread of the drive shaft, the ratchets of which skip over on further anti-clockwise rotation, the ratchets 42 take effect such that the planet gearing can start working, and the cable drum 33 is rotated further via its internal gearing 33*a* in a clockwise direction in reduced drive with increased force.

A switching disc 46 with a readily gripped knurled profile 46*a* and a detent pin 47 rests on bearings in the upper part of the drum. Press fitted into the switching disc is a switch ring 48 with latching grooves 48*a* and ratchet windows 48*b*. In the drum upper part 34 is located a detent pocket 49 which restricts the switching operation of the switching disc 46 via the detent pin 47. Also located in a pocket 50 machined in the upper part of the drum is a ball latching element 51 which locks into the latching grooves 48*a* of the latch ring 48 and holds the switching disc in the set position.

The business of the switching disc is to lift the ratchets 37 out of their effective position by anti-clockwise rotation and thus induce operation only with a reduced gear ratio. In this way, because of the coniform disc braking mechanism described, forwards and backwards operation of the winch is made possible which permits finely adjusted tensioning (hauling) and releasing (slackening) of the lines. Here, the tensioning of the lines takes place in the manner described above. On easing in actuated operation the switching disc 46 is first of all turned anti-clockwise until the detent pin 47 is stopped and by means of which the ratchets 37 are deprived of their function by the switch ring 48. The drum is braked in the manner described above. If a slackening is now to be performed, the drive crank is rotated in a clockwise direction by means of which the brake is deactivated by canceling the clamping between crank socket and drive shaft 38 and the latch clamping ring 39 released.

Figure 13:
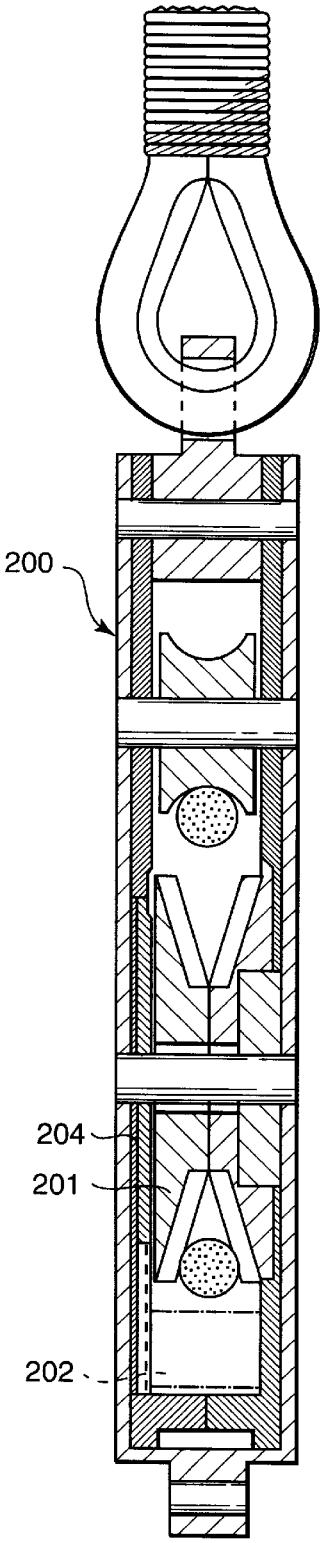

In FIG. 13 a violin block 200 is shown as a side view and a section, FIG. 4, to illustrate an application of the invention and in which the clamping roller is labeled 201 and the looping pin 202. Outside the clamping discs 201 is arranged a circularly spring loaded axis 203 on bearings eccentric to the center of the winch device designed so that the roller 202 running on it can deviate from the looping direction by pulling on the issuing line, affecting the lever 204, and the loop is so far diminished that the line can slide off over the profile.

We claim:

1. A device for gripping and tensioning a line in tackles or pulley blocks, comprising:

interconnected upper and lower coniform discs each having surface contours producing sufficient retention force with only a single loop of the line providing means of traction, the surface contours comprising inwardly directed radial waves having a positive line-engaging profile with a flank angle between 35°–45° set against a pull direction of the line and a flank angle between 35°–45° on an output side, with the flank angle of the pull direction being steeper than the flank angle of the output side, the radial waves also having a trough radius equivalent to or smaller than a radius of the line, and the contouring of the upper coniform disc being modeled in an opposite mirror image direction to the contouring of the lower coniform disc.

2. The device of claim 1, wherein a center line (M) of the surface contours runs through the center of a drum for a corresponding disc.

3. The device of claim 1, wherein the height (H) of the surface contours is at least 2 mm and maximally 3 mm.

4. The device of claim 3, wherein the surface contours are case hardened to reduce wear.

5. The device of claim 1, wherein a wave profile of the upper disc is staggered by ½ a pitch relative to a wave profile of the lower disc.

6. The device of claim 1, including a base in contact with the lower coniform disc and further including a sleeve having a height which extends at least partially through a longitudinal axis between the upper and lower coniform discs, interconnecting the coniform discs with adjustable members, and wherein adjustment of the retention force on the line is implemented by changing the height of the sleeve of the device.

7. The device of claim 6, including an arm connected to the base and at a predetermined distance from the coniform discs and having a longitudinal axis parallel to the longitudinal axis of the coniform discs.

8. The device of claim 7, including a guide-deflector attached to the base arranged adjacent to the arm and at a predetermined distance from the coniform discs with a longitudinal axis parallel to the longitudinal axis of the coniform discs.

9. The device of claim 8, wherein the guide-deflector and the arm from a unit.

10. The device of claim 9, wherein the guide deflector exhibits a cuneiform protuberance projecting into a wedge-shaped groove between the coniform discs, the wedge-shaped groove having a trough maximally corresponding to the thickness of the line to be tensioned.

11. The device of claim 7, wherein the arm comprises a roller that is rotatively spring loaded in a looping direction.

12. The device of claim 11, wherein outside the coniform discs a radially spring loaded lever is mounted on bearings in the base.

13. The device of claim 12, wherein on the lever is located a roller with bearings which secure the loop of line_ and offers the least resistance to the line running through.

14. The device of claim 13, wherein outside the coniform discs is arranged a circularly spring loaded axis on bearings eccentric to the center of the device, and which is so designed that a roller running on it can deviate from the looping direction by pulling on the line running through and the loop so far diminished that the line can slide off over the profile.

15. The device of claim 14, wherein a gear coupling associated with the discs comprises a driven crank socket, formed as a threaded sleeve, a break locking disc and a gear shaft in which the crank socket and the gear shaft bear a left-hand thread for a clockwise-driven winch and the reverse.

16. The device of claim 15, wherein a brake locking disc, formed as a ratchet ring in clamped condition allows only one rotational direction, with the brake locking disc frictionally engaging a thread pitch of the crank socket and gear shaft to impart a braking effect which prohibits the movement of the crank socket and gear shaft until the crank socket is engaged and rotated.

17. The device or claim 16, wherein a ratchet for the direct drive of a drum for the discs is switched on by a switching ring.

18. A device for gripping and tensioning a line in tackles or pulley blocks, comprising:

interconnected upper and lower coniform discs having surface contours comprised of inwardly directed radial waves having a positive line-engaging profile which produce sufficient retention force to provide means of traction with only a single loop of the line;

a base in contact with the lower coniform disc, the base including a sleeve having a height which extends at least partially through a longitudinal axis between the upper and lower coniform discs and interconnecting the coniform discs with adjustable members; and an arm connected to the base at a predetermined distance from the coniform discs and having a longitudinal axis parallel to the longitudinal axis of the coniform discs, the arm including a roller which is rotatively spring loaded in a looping direction.

19. The device of claim 18, wherein the inwardly directed radial waves have a positive line-engaging profile with a flank angle between 35°–45° set against a pull direction of the line and a flank angle between 35°–45° on an output side, with the flank angle of the pull direction being steeper than the flank angle of the output side, the radial waves also having a trough radius equivalent to or smaller than a radius of the line, the wave profile of the upper coniform disc being staggered ½ a pitch relative to the wave profile of the lower coniform disc, the surface contour radial waves having a height of at least 2 mm and maximally 3 mm, and the contouring of the upper coniform disc being modeled in an opposite mirror image direction to the contouring of the lower coniform disc.

20. The device of claim 18, wherein adjustment of the retention force on the line is implemented by changing the height of the sleeve of the device.

21. The device of claim 18, including a guide-deflector attached to the base arranged adjacent to the arm and at a predetermined distance from the coniform discs with a longitudinal axis parallel to the longitudinal axis of the coniform discs, the guide deflector exhibiting a cuneiform protuberance projecting into a wedge-shaped groove between the coniform discs, a trough of the groove maximally corresponding to the thickness of the line to be tensioned.

22. The device of claim 21, wherein the guide-deflector and the arm form a unit.

23. The device of claim 18, wherein outside the coniform discs a radially spring loaded lever mounted on bearings in the base, the lever having a roller with bearings which secure the loop of line and offers the least resistance to the line running through.

24. The device of claim 23, wherein outside the coniform discs is arranged a circularly spring loaded axis on bearings eccentric to the center of the device, and which is so designed that a roller running on it can deviate from the looping direction by pulling on the line running through and the loop so far diminished that the line can slide off over the profile.

25. The device of claim 24, wherein a gear coupling associated with the coniform discs comprises a driven crank socket, formed as a threaded sleeve, a brake locking disc and a gear shaft in which the crank socket and the gear shaft bear a left-hand thread for a clock-wise-driven winch and the reverse.

26. The device of claim 25, wherein the brake locking disc, formed as a ratchet ring in clamped condition allows only one rotational direction, with the brake locking disc frictionally engaging a thread pitch of the crank socket and gear shaft to impart a braking effect which prohibits the movement of the crank socket and gear shaft until the crank socket is engaged and rotated.

27. The device of claim 26, wherein a ratchet for the direct drive of a drum for the discs is switched on by a switching ring.

* * * * *